US008677774B2

(12) United States Patent
Yamaguchi et al.

(10) Patent No.: US 8,677,774 B2
(45) Date of Patent: Mar. 25, 2014

(54) ICE MAKING UNIT FOR A FLOW-DOWN ICE MAKING MACHINE

(75) Inventors: Hiroki Yamaguchi, Toyoake (JP); Yuji Wakatsuki, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 853 days.

(21) Appl. No.: 12/736,164

(22) PCT Filed: Mar. 30, 2009

(86) PCT No.: PCT/JP2009/056527

§ 371 (c)(1),
(2), (4) Date: Sep. 16, 2010

(87) PCT Pub. No.: WO2009/123133

PCT Pub. Date: Oct. 8, 2009

(65) Prior Publication Data

US 2011/0005263 A1 Jan. 13, 2011

(30) Foreign Application Priority Data

Apr. 1, 2008 (JP) ..... 2008-095309
Mar. 26, 2009 (JP) ..... 2009-077178

(51) Int. Cl.
*F25C 1/22* (2006.01)
*A23G 9/00* (2006.01)
*F25D 3/00* (2006.01)

(52) U.S. Cl.
USPC ..... 62/340; 62/345; 62/346; 62/348; 62/389; 62/396; 62/400

(58) Field of Classification Search
USPC ..... 62/304, 340, 345, 346, 348, 378, 379, 62/389, 394, 396, 400
See application file for complete search history.

(56) References Cited

U.S. PATENT DOCUMENTS

| | | | | | |
|---|---|---|---|---|---|
| 3,130,556 | A | * | 4/1964 | Goldsborough | 62/352 |
| 3,206,944 | A | | 9/1965 | Gallo | |
| 3,280,588 | A | * | 10/1966 | Brindley | 62/340 |
| 3,430,452 | A | * | 3/1969 | Dedricks et al. | 62/347 |
| 3,657,899 | A | * | 4/1972 | Hosoda et al. | 62/348 |
| 3,913,349 | A | * | 10/1975 | Johnson | 62/348 |
| 4,085,732 | A | * | 4/1978 | Hysom | 126/675 |
| 4,255,941 | A | * | 3/1981 | Bouloy | 62/348 |
| 4,342,204 | A | * | 8/1982 | Melikian et al. | 62/304 |
| 4,344,298 | A | * | 8/1982 | Biemiller | 62/347 |
| 4,354,360 | A | * | 10/1982 | Fiske | 62/348 |

(Continued)

FOREIGN PATENT DOCUMENTS

| | | |
|---|---|---|
| JP | H07-6657 | 1/1995 |
| JP | 2006-25906 | 2/2006 |
| JP | 2007-024472 | 2/2007 |

*Primary Examiner* — Ljiljana Ciric
(74) *Attorney, Agent, or Firm* — DLA Piper LLP (US)

(57) ABSTRACT

Ice making portions of an ice making machine have a pair of ice making plates disposed vertically and an evaporation tube disposed between back faces of the ice making plates. A plurality of vertically extending projected rims are formed at predetermined intervals widthwise on a surface of each ice making plate to define a plurality of ice making regions. The ice making plates facing the ice making regions are provided with consecutive vertical steps of inclined portions inclined from a back side towards a front side as directed downwardly, and contact horizontal extensions of the evaporation tube at a vertically intermediate position on a back face of each inclined portion.

4 Claims, 8 Drawing Sheets

(56) References Cited

U.S. PATENT DOCUMENTS

| | | | | | |
|---|---|---|---|---|---|
| 4,363,220 | A | * | 12/1982 | Ripley | 62/347 |
| 4,368,625 | A | * | 1/1983 | Platt | 62/378 |
| T103,001 | I4 | * | 5/1983 | Marks | 62/348 |
| 4,412,429 | A | * | 11/1983 | Kohl | 62/347 |
| 4,442,681 | A | * | 4/1984 | Fischer | 62/347 |
| 4,474,023 | A | * | 10/1984 | Mullins, Jr. | 62/347 |
| 4,501,130 | A | * | 2/1985 | Izumi | 62/304 |
| 4,526,014 | A | * | 7/1985 | Suyama et al. | 62/347 |
| 4,531,380 | A | * | 7/1985 | Hagen | 62/348 |
| 4,558,572 | A | * | 12/1985 | Aoki et al. | 62/378 |
| 4,589,261 | A | * | 5/1986 | Ohashi et al. | 62/347 |
| 4,590,774 | A | * | 5/1986 | Povajnuk | 62/348 |
| 4,688,386 | A | * | 8/1987 | Lane et al. | 62/348 |
| 4,706,465 | A | * | 11/1987 | Searl | 62/353 |
| 4,823,559 | A | * | 4/1989 | Hagen | 62/347 |
| 4,843,827 | A | * | 7/1989 | Peppers | 62/352 |
| 4,934,150 | A | * | 6/1990 | Fessler | 62/59 |
| 4,938,030 | A | * | 7/1990 | Josten et al. | 62/348 |
| 4,947,653 | A | * | 8/1990 | Day et al. | 62/73 |
| 4,970,876 | A | * | 11/1990 | Vinokurov | 62/304 |
| 4,986,088 | A | * | 1/1991 | Nelson | 62/347 |
| 4,995,245 | A | * | 2/1991 | Chang | 403/340 |
| 5,182,925 | A | * | 2/1993 | Alvarez et al. | 62/347 |
| 5,193,357 | A | * | 3/1993 | Kohl et al. | 62/347 |
| RE34,210 | E | * | 4/1993 | Lane et al. | 62/348 |
| 5,329,780 | A | * | 7/1994 | Broadbent | 62/72 |
| 5,586,439 | A | * | 12/1996 | Schlosser et al. | 62/78 |
| 5,941,091 | A | * | 8/1999 | Broadbent | 62/347 |
| 6,205,807 | B1 | * | 3/2001 | Broadbent | 62/347 |
| 6,286,331 | B1 | * | 9/2001 | Lee | 62/340 |
| 6,311,501 | B1 | * | 11/2001 | Allison et al. | 62/347 |
| 7,017,355 | B2 | * | 3/2006 | Allison et al. | 62/74 |
| 7,032,406 | B2 | * | 4/2006 | Hollen et al. | 62/347 |
| 7,243,508 | B2 | * | 7/2007 | Sanuki et al. | 62/347 |
| 7,703,299 | B2 | * | 4/2010 | Schlosser et al. | 62/347 |
| 7,832,219 | B2 | * | 11/2010 | Baranowski et al. | 62/347 |
| 8,534,087 | B2 | * | 9/2013 | Lee et al. | 62/345 |
| 8,534,089 | B2 | * | 9/2013 | An et al. | 62/348 |
| 8,555,774 | B2 | * | 10/2013 | Mitchell et al. | 62/389 |
| 8,561,675 | B2 | * | 10/2013 | Liu et al. | 62/304 |
| 8,573,719 | B2 | * | 11/2013 | Lee et al. | 62/340 |
| 8,584,474 | B2 | * | 11/2013 | McCollough et al. | 62/340 |
| 8,601,829 | B2 | * | 12/2013 | Heger et al. | 62/340 |

* cited by examiner ( a )

( b )

ICE MAKING UNIT FOR A FLOW-DOWN ICE MAKING MACHINE

TECHNICAL FIELD

The present invention relates to an ice making unit of a flow-down type ice making machine that generates ice blocks in an ice making region by flow-down supplying ice making water to the ice making region of an ice making plate having a back face provided with an evaporation tube.

BACKGROUND ART

As an ice making machine automatically producing ice blocks, a flow-down type ice making machine is known in which an ice making unit is configured with an ice making portion in which a pair of ice making plates are disposed facing each other approximately vertically sandwiching an evaporation tube configuring a refrigeration system, ice blocks are generated by flow-down supplying ice making water on a surface (ice making surface) of each of the ice making plates cooled by a refrigerant circulatively supplied to the evaporation tube in ice making operation, and the ice blocks are separated by shifting to deicing operation to fall down and released (for example, refer to Patent Document 1). Such a flow-down type ice making machine warms the ice making plates by supplying a hot gas to the evaporation tube in deicing operation and also flowing deicing water at normal temperature down on a back face of the ice making plates, and allows the ice blocks to fall down under its own weight by melting a frozen portion with the ice making surface in the ice blocks.

In the flow-down type ice making machine, a configuration is employed in which a projection projecting outwardly is provided between positions of vertically forming ice blocks on the ice making surface of each ice making plate and such an ice block sliding down along the ice making surface in deicing operation is stranded on the projection, thereby preventing the ice block from not falling down by being caught in an ice block below to prevent the ice blocks to be melted more than necessary. Patent Document 1: Japanese Laid-Open Patent [Kokai] Publication No. 2006-52906

DISCLOSURE OF THE INVENTION

Problem to be Solved by the Invention

In the flow-down type ice making machine, since melted water generated by melting of the frozen portion in deicing operation enters between the ice making surface and the ice block sliding down along the ice making surface, even when a lower end of the ice block touches a projection, the ice block is sometimes not stranded on the projection due to surface tension of the melted water and the ice block may not be spaced apart from the ice making surface to end up staying at an upper portion of the projection. As an ice block stays at an upper portion of a projection in such a manner, the ice block is melted more than necessary, which leads to a decrease in ice production per cycle. Moreover, excessive melting generates uneven reduction in an ice block and the like and ends up forming an ice block having poor appearance. In addition, when an ice block falls down from above over an ice block staying at an upper portion of a projection and ends up abutting and be caught in the staying ice block, there is also a possibility of occurring doubly making ice.

In a configuration of providing a projection on an ice making surface as in the flow-down type ice making machine, when an ice block grows to such a position to make contact with a projection upon completion of ice making operation, the ice block cannot be stranded on the projection by the speed of sliding down along the ice making surface in deicing operation, and suppression of falling down due to the surface tension of the melted water described above becomes apparent. Therefore, vertical intervals from the evaporation tube provided on the back face of the ice making plate are enlarged not to grow an ice block to such a position to make contact with the projection upon completion of ice making operation. However, drawbacks are pointed out, in this case, that the vertical dimension of the ice making plate itself becomes longer and the vertical installation space of the ice making unit is enlarged, so that the ice making machine itself also becomes larger in size.

Here, the pair of ice making plates facing each other sandwiching the evaporation tube are positioned in parallel apart by the diameter of the evaporation tube, and in deicing operation, deicing water is supplied from above to a gap between both ice making plates positioned above an uppermost portion of the evaporation tube. In this case, since the gap between both ice making plates is wide (same as the diameter of the evaporation tube), most of the deicing water supplied from above is directly supplied to the evaporation tube without flowing the back faces of the ice making plates above the uppermost portion of the evaporation tube. Therefore, there has been a problem that it takes time to melt a frozen face above the evaporation tube in an uppermost portion of an ice block and thus other areas of the ice block ends up being melted more than necessary.

In an ice making plate provided with such a projection, when a lower end of the ice block sliding down along an ice making surface abuts the projection, an ice block sometimes rotates using the lower end as a fulcrum point. Therefore, in a case of configuring an ice making unit by disposing a plurality of ice making portions in parallel, it is required to enlarge intervals between adjacent ice making portions not to allow an ice block falling down while rotating to stay between the facing ice making plates to get stuck, so that drawbacks are pointed out that the parallel installation space for the ice making portions in the ice making unit becomes larger and the ice making machine also becomes larger in size.

Consequently, in view of the problems inherent in an ice making unit of a conventional flow-down type ice making machine, the present invention is proposed to solve them suitably and it is an object of the present invention to provide an ice making unit of a flow-down type ice making machine in which ice blocks can be separated promptly from the ice making plates so that the ice making capacity is improved and also downsizing can be sought.

Means for Solving the Problem

In order to solve the problems and achieve the desired object, an ice making unit of a flow-down type ice making machine according to the present invention is an ice making unit of a flow-down type ice making machine, comprising an ice making portion having: an ice making plate provided, horizontally at every predetermined interval, with a plurality of projected rims projecting out on a front side and also extending vertically; and an evaporation tube disposed on a back face of the ice making plate and winding to have horizontally extending horizontal extensions vertically apart from each other, to generate an ice block by supplying ice making water to an ice making surface portion positioned between the projected rims in the ice making plate, wherein the ice making surface portion is provided with vertically multi steps of inclined portions inclined from a back side to a front side as directed downwardly from above, an lower inclination end of each inclined portion is configured to be positioned closer to the front side than an upper inclination end of an inclined portion positioned below, and the horizontal extensions of the evaporation tube are disposed to make contact with a back face of each inclined portion.

Effect of the Invention

According to an ice making unit of a flow-down type ice making machine of the present invention, ice blocks are separated and fall down promptly from ice making plates, so that the ice making capacity is improved. In addition, downsizing of the ice making unit can be sought.

BEST MODE FOR CARRYING OUT THE INVENTION

Next, a description is given below to an ice making unit of a flow-down type ice making machine according to the present invention by way of preferred Embodiments with reference to the attached drawings.

Embodiments

Figure 1:
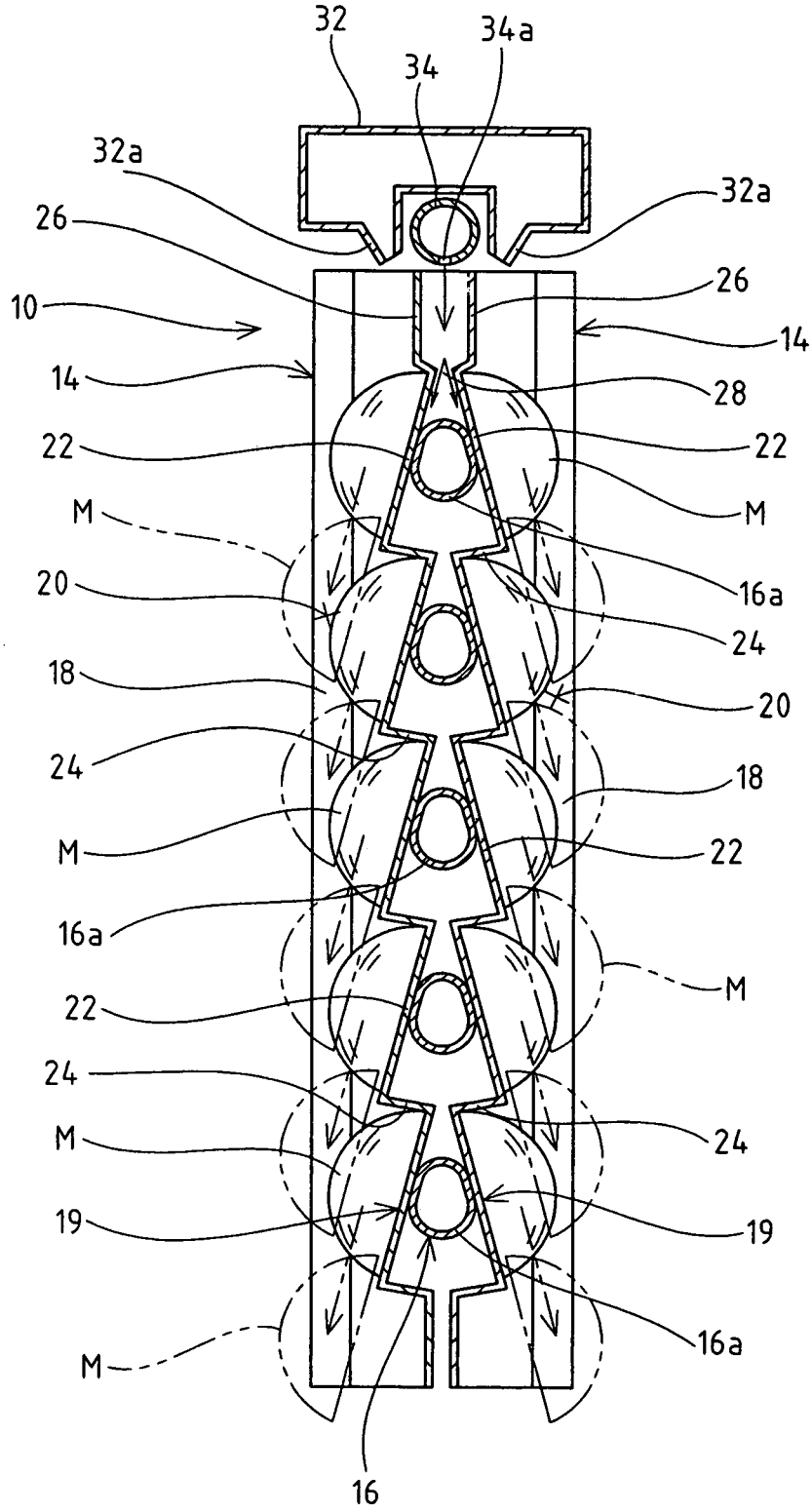
FIG. 1 is a vertical section side view illustrating an ice making portion according to an Embodiment.
Figure 2:
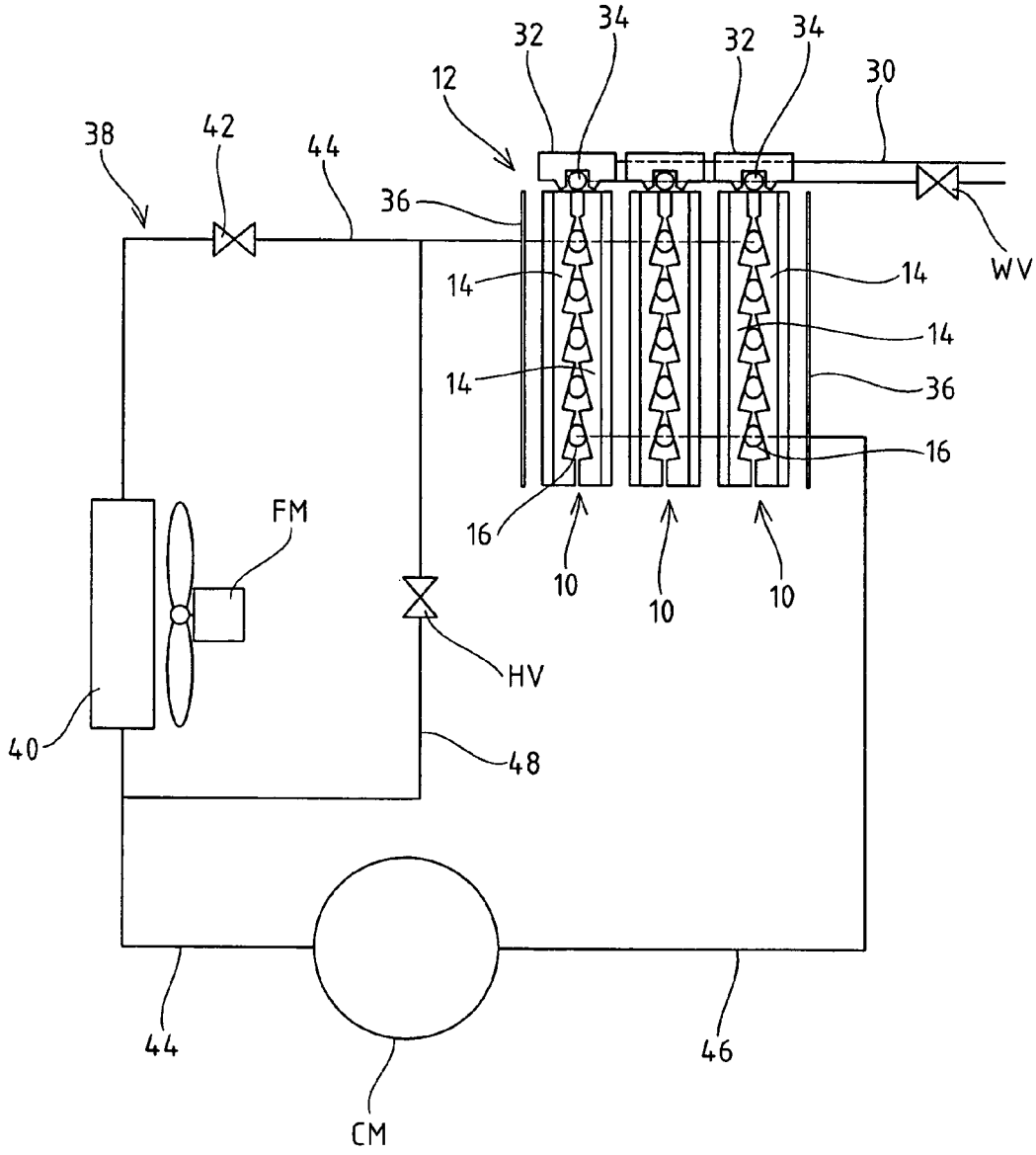
FIG. 2 is a schematic configuration diagram of a flow-down type ice making machine provided with an ice making unit according to the Embodiment.
Figure 3:
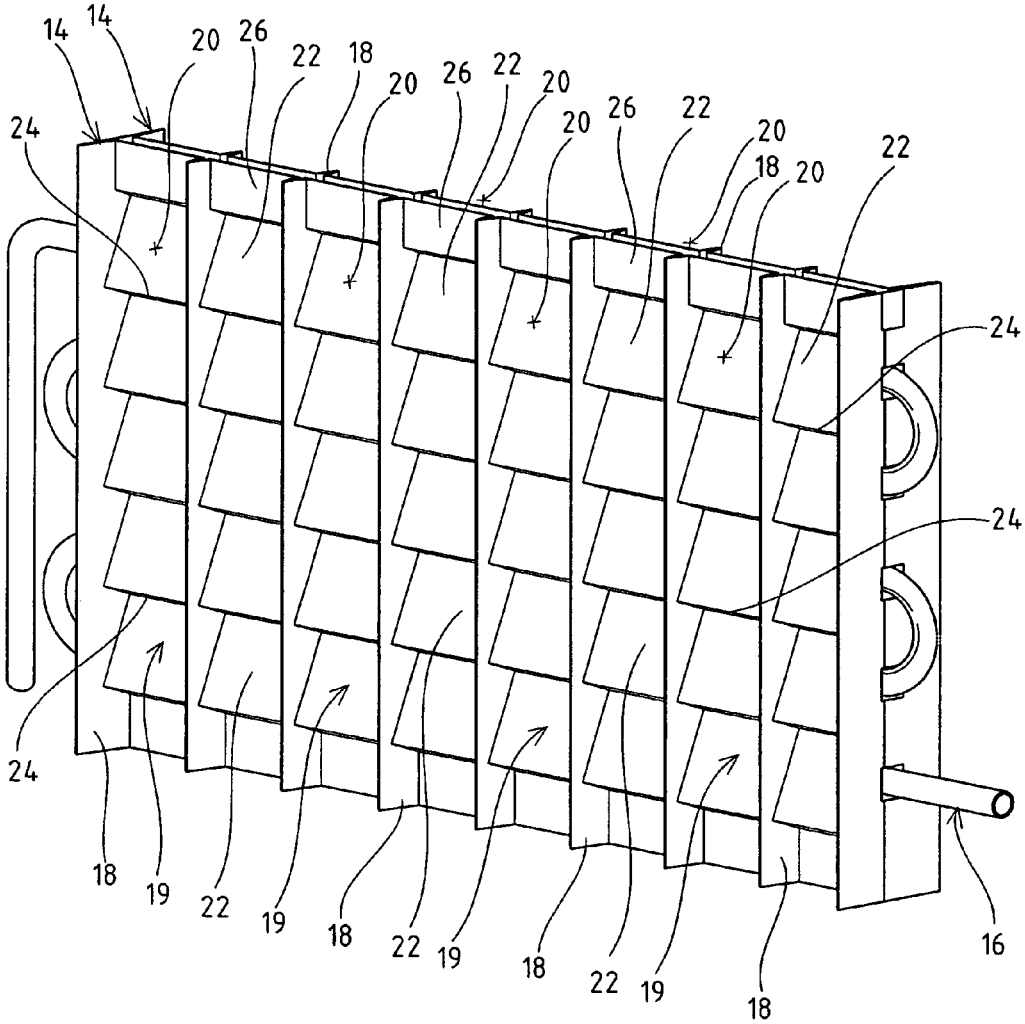
FIG. 3 is a schematic perspective view of the ice making portion illustrated in FIG. 1.
Figure 4:
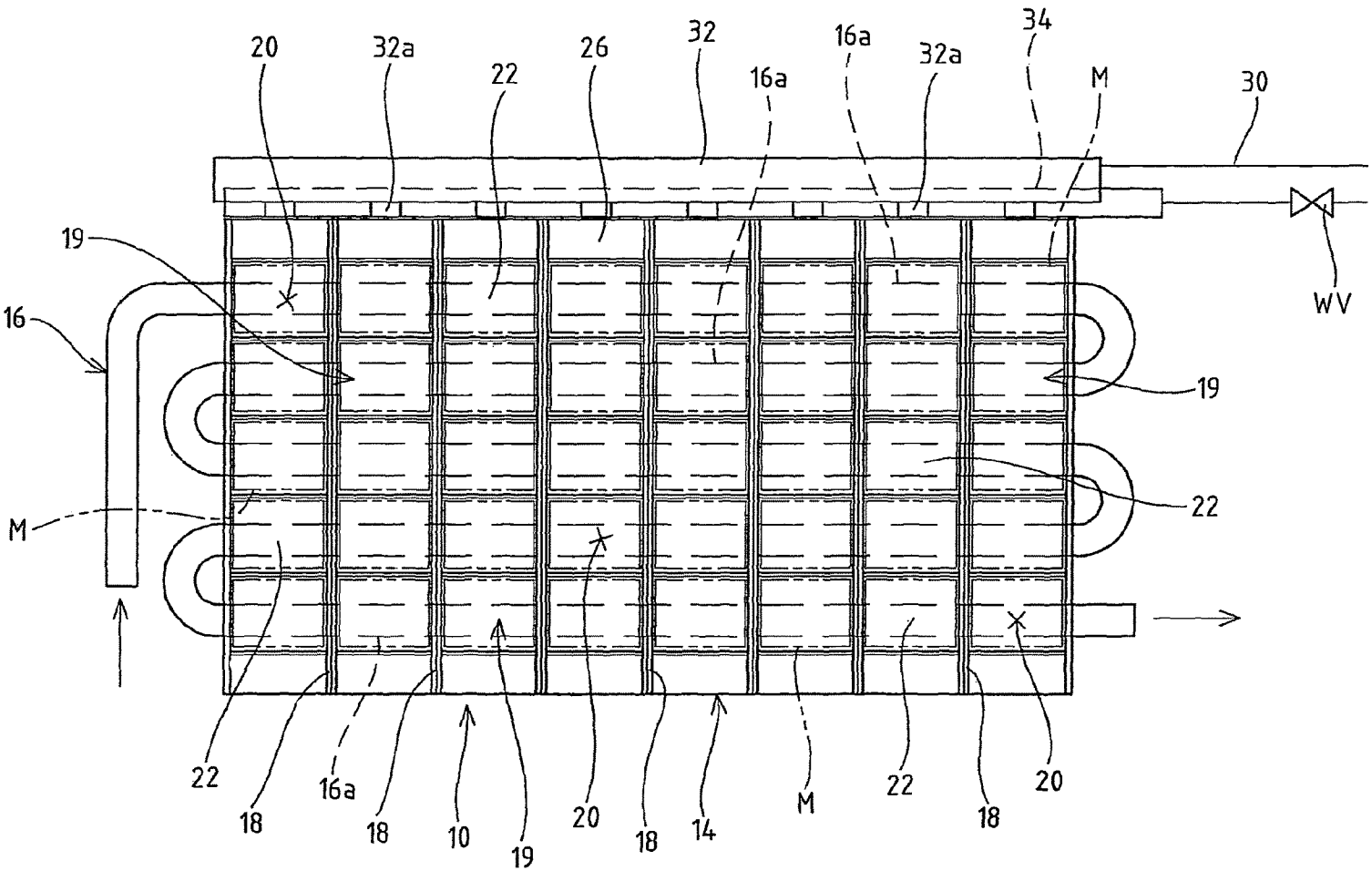
FIG. 4 is a front view illustrating the ice making portion according to the Embodiment.

FIG. 1 is a vertical section side view illustrating an ice making portion 10 according to an Embodiment of the present invention, and FIG. 2 is a schematic configuration diagram of a flow-down type ice making machine provided with an ice making unit 12 configured by disposing a plurality of ice making portions 10 in parallel. FIG. 3 is a schematic perspective view illustrating the entire ice making portions 10 illustrated in FIG. 1. The flow-down type ice making machine has the ice making unit 12 disposed above an ice storage internally defined in a thermally insulating box (both not shown) and is designed to release and store ice blocks M produced in the ice making unit 12 in the ice storage below. Each ice making portion 10 configuring the ice making unit 12 is provided, as illustrated in FIGS. 1 and 3, with a pair of ice making plates 14, 14 disposed vertically and an evaporation tube 16 disposed between facing back faces of both the ice making plates 14, 14. The evaporation tube 16 has, as illustrated in FIG. 4, horizontal extensions 16*a* extending horizontally (widthwise) to each ice making portion 10 that are formed reciprocately windingly and spaced apart vertically, so that the horizontal extensions 16*a* make contact with the back faces of both ice making plates 14, 14. A refrigerant is circulated in the evaporation tubes 16 in ice making operation, thereby configured to forcibly cool both the ice making plates 14, 14.

On a surface (ice making surface) of each of the ice making plates 14, 14, as illustrated in FIGS. 3 and 4, a plurality of vertically extending projected rims 18 are formed at predetermined intervals widthwise, and a plurality (eight arrays in this Embodiment) of ice making regions 20 are defined in a horizontal alignment apart from each other widthwise by these projected rims 18. Each ice making region 20 is defined by a pair of adjacent projected rims 18, 18 and an ice making surface portion 19 positioned between both projected rims 18, 18 and is configured to be open on the front side and vertically. Each of the ice making surface portions 19 defining each ice making region 20 in each ice making plate 14 is, as illustrated in FIGS. 1 and 3, configured by being provided with vertically multi steps (five steps in this Embodiment) of inclined portions 22 inclined from the back side to the front side as directed downwardly from above, and each horizontal extension 16*a* of the evaporation tube 16 are disposed so as to make contact with an approximate vertical intermediate position on a back face of each inclined portion 22. In a lower inclination end of each inclined portion 22, a link portion 24 linked to an upper inclination end of the inclined portion 22 positioned below is provided and the link portion 24 is inclined downwardly to the back side. That is, the inclined portions 22, 22 above and below coupled via the link portion 24 are configured to have a relationship in which the lower inclination end of the inclined portion 22 above is positioned closer to the front than the upper inclination end of the inclined portion 22 below. Accordingly, the ice making surface portion 19 of each ice making region 20 is formed in a concave and convex stepwise shape in which convexities and concavities are alternately and vertically disposed by the inclined portions 22 and the link portions 24.

Figure 6:
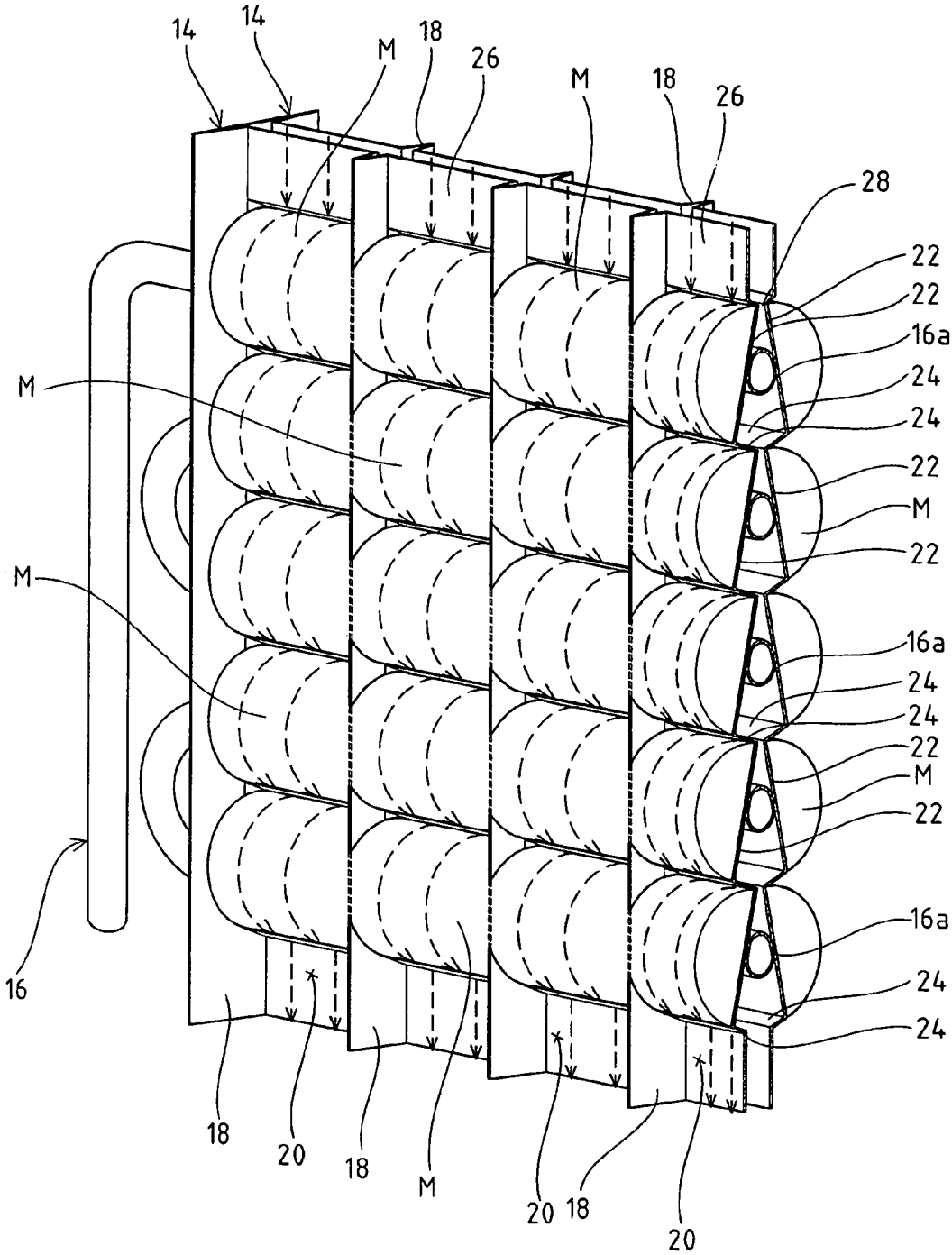
FIG. 6 is a partial perspective view illustrating a state of forming an ice block on each inclination and also flowing the ice making water down along a surface of the ice block.

Each of the projected rims 18 projects, as illustrated in FIGS. 3, 6, and the like, to be tapered off towards the front, and each ice making region 20 sandwiched by the projected rims 18, 18 facing each other widthwise is open to gradually expand as directed from the ice making surface portion 19 towards the front. As illustrated in FIG. 3 and also as described above, the ice making surface portion 19 of each of the ice making region 20 is in a concave and convex stepwise shape relative to front and back by forming the inclined portions 22 and the link portions 24 vertically alternately, thereby linking the ice making surface portion 19 and the projected rims 18, 18 in a zigzag manner displaced vertically and alternately relative to front and back. Accordingly, deformation of each of the projected rim 18 is regulated so as not to displace the projecting end across the width of the ice making plate 14 to fall on either side of the ice making regions 20 positioned on both sides, so that the ice making regions 20 are maintained in the expanded open state described above. In deicing operation, this prevents the ice blocks M formed in the ice making regions 20 from being caught in the projected rims 18, 18 positioned on both sides and from being delayed in the slide.

In the upper inclination end of each inclined portion 22 in an uppermost portion, as illustrated in FIG. 1, a feed portion 26 is provided that is formed by bending obliquely upwardly towards the front side and then bending to extend upwardly. The feed portions 26, 26 extend in parallel in the pair of ice making plates 14, 14 facing each other sandwiching the evaporation tube 16 and there is an opening upwardly between both the feed portions 26, 26. Between the upper inclination ends on the back faces of the pair of inclined portions 22, 22 facing each other sandwiching the horizontal extensions 16*a* of the evaporation tube 16 in the uppermost portion, a channel 28 for deicing water having a width narrower than the diameter (diameter of an upper arc area in the horizontal extension 16*a*) of the evaporation tube 16 is formed, and it is configured to flow deicing water sprayed from a deicing water spray 34 described later through the channel 28 to the back face of each inclined portion 22.

The horizontal extensions 16*a* of the evaporation tube 16 are, in the cross section illustrated in FIG. 1, formed by coupling the upper arc area and a lower arc area set to have a larger diameter than the upper arc area with straight areas on both sides of right and left. Both straight areas extend in parallel with the corresponding inclined portions 22, 22 to make surface contact with the back faces of the inclined portions 22, 22, and are configured to enable efficient heat exchange between the inclined portions 22 and a refrigerant or a hot gas communicating in the horizontal extensions 16*a*.

Below the ice making unit 12, an ice making water tank (not shown) is provided in which a predetermined amount of ice making water is stored, and an ice making water supply tube 30 led out of the ice making water tank via a circulation pump (not shown) is connected to respective ice making water sprays 32 provided above the respective ice making portions 10. Each of the ice making water sprays 32 is, as illustrated in FIG. 4, provided with water spray nozzles 32*a* at positions corresponding to the respective ice making regions 20 and is configured to spray the ice making water, which is pumped from the ice making water tank in ice making operation, from the water spray nozzles 32*a* on the ice making surfaces (ice making surface portions 19) facing the respective ice making regions 20 cooled to a freezing temperature of both the ice making plates 14, 14. The ice making water falling down on each ice making surface falls down sequentially on the inclined portion 22→the link portion 24→the inclined portion 22→the link portion 24 . . . in the ice making region 20, and freezes on the inclined portions 22 with which the horizontal extensions 16*a* of the evaporation tube 16 make contact in each inclined portion 22, thereby being designed to generate the ice blocks M in a predetermined shape on the ice making surfaces (front faces) of the inclined portions 22 as illustrated in FIGS. 1 and 6.

Above each of the ice making portions 10, the deicing water spray 34 is provided that faces above a space between the pair of ice making plates 14, 14 and extends across the width of the ice making portion 10. In the deicing water spray 34, as illustrated in FIG. 1, a water spray hole 34*a* is perforated at a position facing a space between the feed portions 26, 26 corresponding to each ice making region 20 on the back faces of both the ice making plates 14, 14. The deicing water sprays 34 are connected to an external water supply source via a feed water valve WV, and are configured to spray the deicing water from each water spray hole 34*a* towards the channel 28 on the back faces of the corresponding ice making surface portions 19, 19 (ice making regions 20, 20) by opening the feed water valve WV in deicing operation.

Figure 8:
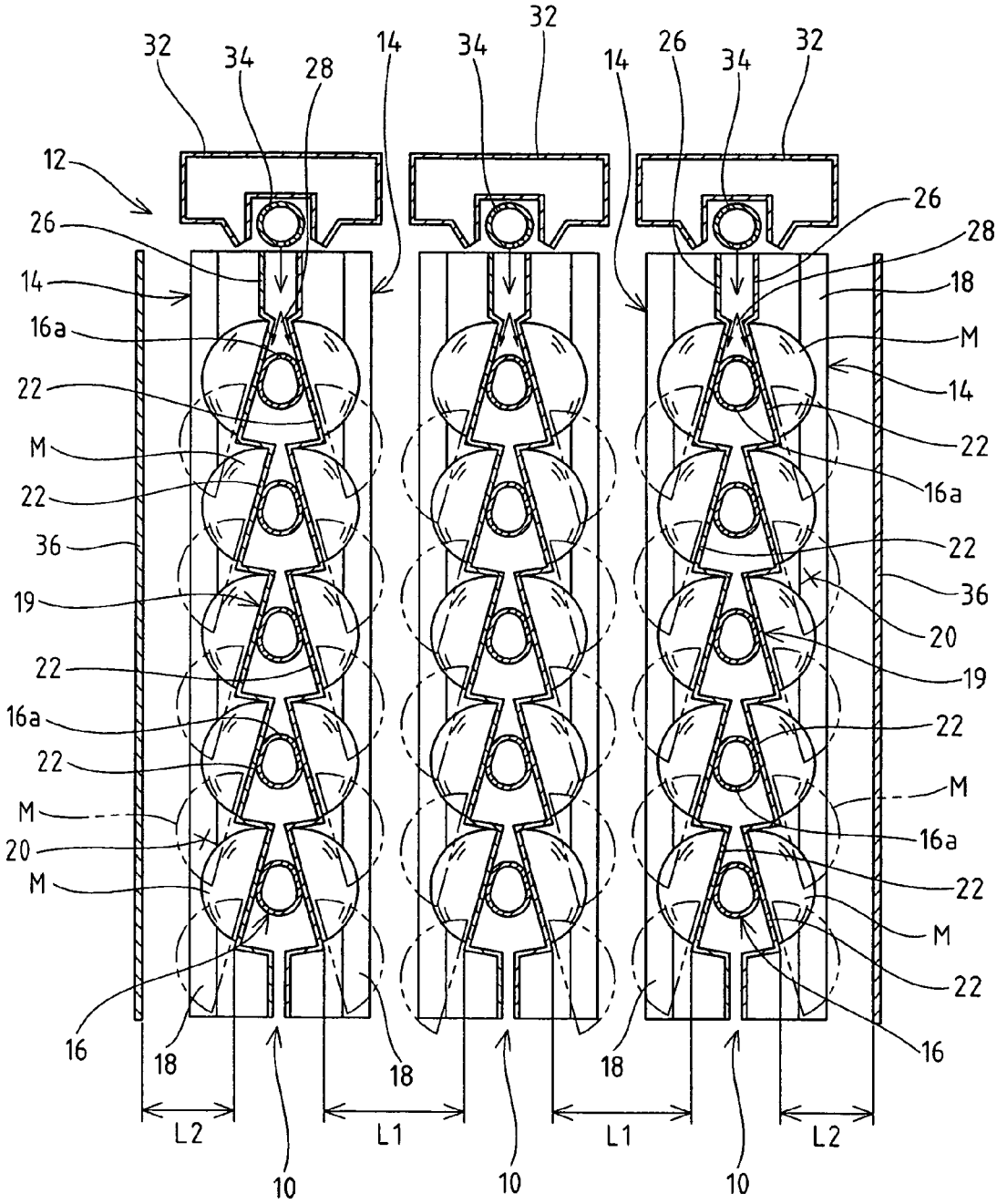
FIG. 8 is a vertical section side view illustrating the ice making unit according to the Embodiment.

Each of the ice making unit 12 is configured with the plurality of ice making portions 10 configured as described above, in which, as illustrated in FIG. 8, the surfaces of the ice making plates 14 in each the ice making portion 10 are disposed in parallel so as to face each other apart at a predetermined interval. On both sides of the alignment of the ice making portions 10 in the ice making unit 12, respective side walls 36 are disposed apart at a predetermined interval from the surfaces of the ice making plates 14 in the outermost ice making portions 10, so that the ice making unit 12 is surrounded by both side walls 36, 36. The intervals separating the respective ice making portions 10 in the ice making unit 12 and the intervals separating the outermost ice making portions 10 from the corresponding side walls 36 are made to be in minimum required dimensions without considering that the ice blocks M fall down from the ice making portions 10 while rotating, as described later. For example, a separated distance L1 between the lower inclination ends of the inclined portions 22, 22, which are the areas in which the adjacent ice making portions 10, 10 becomes closest, and is set to be approximately the same as a diameter of a circle drawn by rotating an ice block M using the middle of the plane used to be in contact with the inclined portion 22 as a center. In addition, a separated distance L2 between the lower inclination ends of the inclined portions 22 in the outermost ice making portions 10 and the corresponding side walls 36 is set to be smaller than the diameter of the circle drawn by rotating an ice block M using the aforementioned part as a center, and to be in a dimension larger than the maximum thickness of the ice block M generated on the inclined portion 22 in a direction orthogonal to the ice making surface.

A refrigeration device 38 of the flow-down type ice making machine is configured, as illustrated in FIG. 2, by connecting a compressor CM, a condenser 40, an expansion valve 42, and the evaporation tube 16 of each of the ice making portions 10 in this order with refrigerant tubes 44, 46. In ice making operation, a vaporized refrigerant compressed by the compressor CM is designed to go through the outlet tube (refrigerant tube) 44, to be condensed and liquefied by the condenser 40, to be depressurized by the expansion valve 42 and to flow into the evaporation tube 16 of each ice making portion 10 to expand at once here for evaporation, and to exchange heat with the ice making plates 14, 14 to cool the ice making plates 14, 14 to below freezing point. The vaporized refrigerant evaporated in all evaporation tubes 16 reciprocates a cycle of returning to the compressor CM through the inlet tube (refrigerant tube) 46 and being supplied to the condenser 40 again. The refrigeration device 38 is provided with a hot gas tube 48 branched from the outlet tube 44 of the compressor CM, and the hot gas tube 48 is in communication with an entrance side of each evaporation tube 16 via a hot gas valve HV. The hot gas valve HV is controlled to be closed in ice making operation and open in deicing operation. In deicing operation, it is configured to bypass the hot gas discharged from the compressor CM to each evaporation tube 16 through the open hot gas valve HV and the hot gas tube 48 to heat the ice making plates 14, 14, thereby melting a frozen face of an ice block M generated on the ice making surface to allow the ice block M to fall down under its own weight. That is, by controlling the opening and closing of the hot gas valve HV under operation of the compressor CM, ice making operation and deicing operation are repeated alternately, and thus ice blocks M are designed to be produced. The reference character FM in the drawing denotes a fan motor that is operated (turned ON) in ice making operation to air cool the condenser 40. The refrigerant entrance side of each evaporation tube 16 is set to be positioned at an upper portion of the ice making portions 10 and the refrigerant exit side of each evaporation tube 16 is set to be positioned at a lower portion of the ice making portions 10, and the refrigerant and the hot gas supplied to the evaporation tubes 16 are configured to flow downwardly from above.

Operation of Embodiment

Next, a description is given below to operation of an ice making unit of a flow-down type ice making machine according to this Embodiment.

Figure 5:
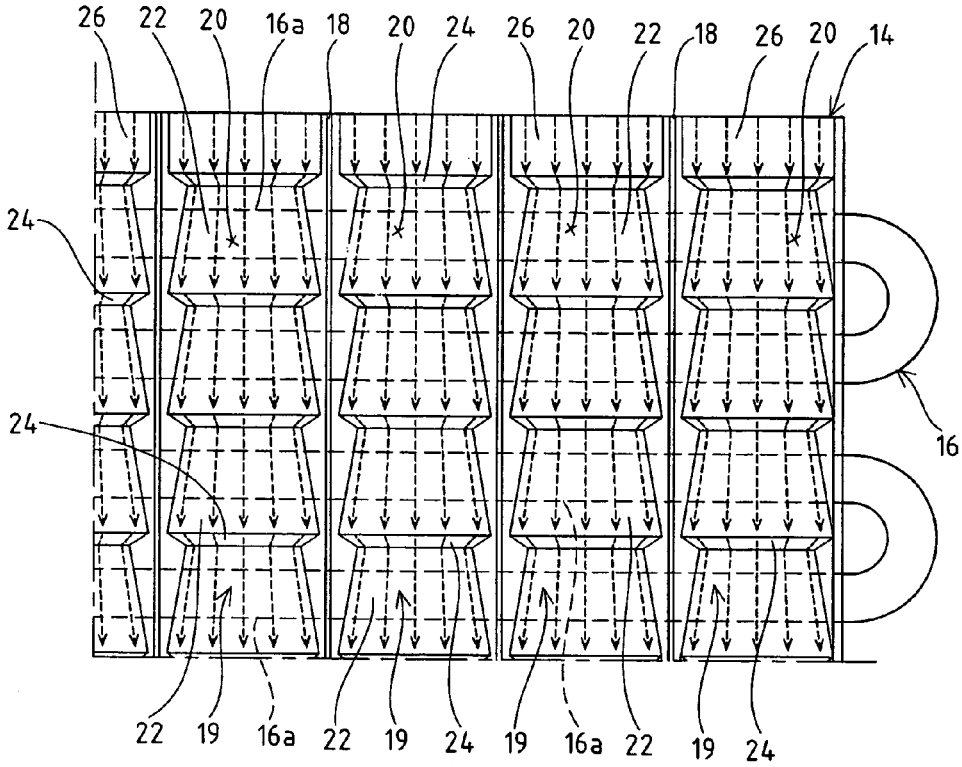
FIG. 5A is a partial front view illustrating a state of supplying ice making water to each ice making region in ice making plates of the ice making portion.
FIG. 5B is a vertical section side view of FIG. 5A.
Figure 5:
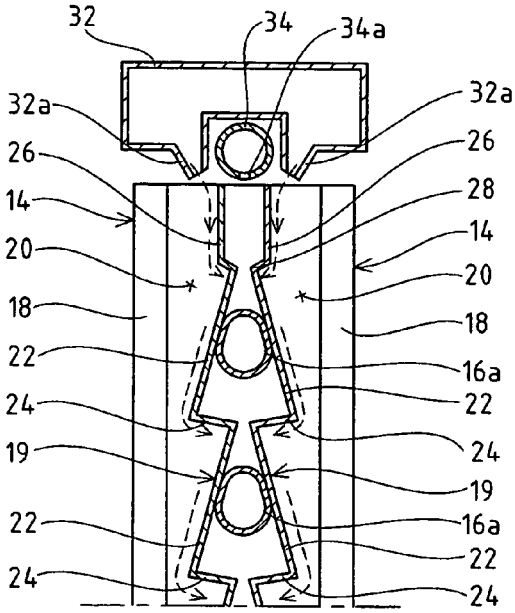

In ice making operation of a flow-down type ice making machine, each inclined portion 22 in each ice making plate 14 is forcibly cooled by exchanging heat with the refrigerant circulating in the evaporation tube 16. In such a situation, the circulation pump is activated to supply the ice making water stored in the ice making water tank to each ice making region 20 of both the ice making plates 14, 14 through the ice making water sprays 32. The ice making water supplied to each ice making region 20, as illustrated in FIGS. 5A and 5B, falls down from the feed portion 26 to the uppermost inclined portion 22, and then repeats a step of flowing from an lower inclination end of the inclined portion 22 through the link portion 24 to the inclined portion 22 below, to reach the lowermost inclined portion 22. At this point, since the inclined portion 22 is inclined to displace towards the front side as directed downwardly, the flow down rate of the ice making water becomes smaller compared to a case of a vertical plane, and the ice making water spreads out on the entire surface of the inclined portion 22 (FIG. 5A). The ice making water having fallen down while spreading out on the entire inclined portion 22 falls down from the lower inclination end of the inclined portion 22 along the link portion 24, and flows into a concavity defined by the link portion 24 and the inclined portion 22 below. The ice making water flowing into the concavity falls down again while spreading out towards the inclined portion 22 below. That is, the ice making surface portion 19 is in a concave and convex shape with the inclined portions 22 and the link portions 24, thereby suppressing an increase of the flow down rate of the ice making water falling down the ice making surface portion 19, and thus the ice making water falls down while spreading out on the entire surface of each cooled inclined portion 22. Accordingly, the heat exchange is carried out efficiently between the ice making water and each inclined portion 22 cooled by making contact with the horizontal extensions 16*a* in the evaporation tube 16, and the ice making water gradually begins to freeze on the ice making surface of each inclined portion 22. The ice making water falling down from the ice making plates 14, 14 without being frozen is collected into the ice making water tank and circulates so as to be supplied to the ice making plates 14, 14 again.

As the supply of the ice making water to each ice making region 20 of both the ice making plates 14, 14 through the ice making water sprays 32 is continued, the ice block M is gradually formed on each inclined portion 22 of each ice making region 20. This allows the ice making water to, as illustrated in FIG. 6, fall down along an outer surface of an ice block M that projects on the inclined portion 22 during formation, and the ice block M becomes larger gradually. The ice making water having fallen down on the outer surface of the ice block M above flows into the concavity defined between the inclined portion 22 below and the link portion 24 linked to the inclined portion 22 above, and the falling down of the ice making water is reduced in energy and the flow down rate becomes smaller. Moreover, in the concavity as illustrated in FIGS. 1 and 6, an upper end of the ice block M below is positioned closer to the back side than a lower end of the ice block M above, so that the path from where the ice making water flows into to where it flows out becomes longer. Furthermore, by forming the ice block M on the inclined portion 22, as illustrated in FIGS. 1 and 6, the upper end portion of the ice block M facing the concavity becomes approximately horizontal and a distance on the outer surface from the upper end portion of the ice block M to a portion maximally projecting out to the front side becomes longer. This allows the ice making water flowing into the concavity from the outer surface of the ice block M above to be reduced in energy and speed, followed by moving to the outer surface of the ice block M below and slowly falling down along the outer surface of the ice block M below. That is, the ice making water is reduced in energy and speed in the concavity and then falls down slowly on the outer surface of each ice block M, thereby suitably suppressing the spattering of the ice making water generated due to the flow down rate that becomes larger.

As a predetermined time period for making ice passes and an ice making completion detecting means, not shown, detects the completion of ice making operation, the ice making operation is terminated and deicing operation is started. Upon completion of the ice making operation, as illustrated in FIG. 1, in each ice making region 20 of the ice making plates 14, an ice block M is generated on each inclined portion 22, which is a contact area of the horizontal extension 16*a* in the evaporation tube 16 with the ice making plate 14. The ice making operation is set to be completed in such a size of the ice block M not to outwardly extend it below the lower inclination end of the inclined portion 22. The amount of horizontal projection of the projected rims 18 is made small, thereby transversely coupling the ice block M formed on each inclined portion 22 of each ice making region 20, as illustrated in FIG. 6, with the ice block M formed on the inclined portion 22 adjacent widthwise beyond the projected rim 18.

Due to the start of the deicing operation, the hot gas valve HV is open to circulatively supply a hot gas to the evaporation tubes 16, and the feed water valve WV is open to supply deicing water to the back faces of the ice making plates 14, 14 through the deicing water sprays 34, thereby heating the ice making plates 14, 14 to melt the frozen face of each ice block M. The deicing water having fallen down the back faces of the ice making plates 14, 14 is collected into the ice making water tank in the same manner as the ice making water, and that is used as the ice making water for the next time.

As the ice making plates 14 are heated due to the deicing operation, the frozen face of each ice block M with the inclined portion 22 is melted and the ice block M begins to slide down on the inclined portion 22. There is no projection or the like that inhibits sliding of the ice block M on the ice making surface of the inclined portion 22, so that the ice block M are promptly separated from the lower inclination end of the inclined portion 22 to fall down.

As all ice blocks M are separated from the ice making plates 14, 14 and a deicing completion detecting means, not shown, detects completion of deicing due to raise in temperature of the hot gas, the deicing operation is terminated and then ice making operation is started to reciprocate the ice making—deicing cycle described above.

Figure 7:
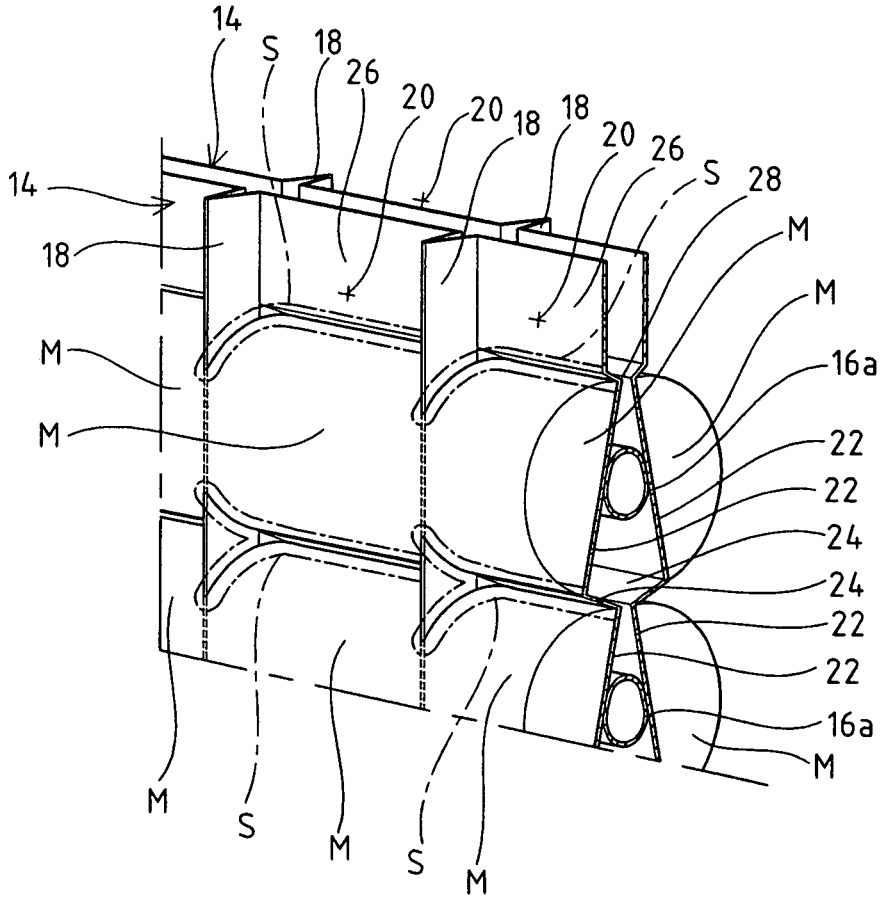
FIG. 7 is a descriptive perspective view illustrating that, by horizontally coupling the respective ice blocks beyond projected rims, a region of forming a scale along an edge of the ice block is shortened.

Due to the repeated ice making operations, as illustrated in FIG. 7, scales S are formed in areas along edges of each ice block M with each inclined portion 22 and each projected rim 18. Here, as illustrated in FIG. 7 and described above, since the ice blocks M adjacent widthwise are transversely coupled to each other beyond the projected rim 18, no scale S is formed in the portions where the ice blocks M are coupled in each projected rim 18. Accordingly, in the areas along the ice blocks M in the projected rims 18, the length of the scales S thus formed becomes shorter, and such a scale S is formed by being divided into an area along an upper edge and an area along a lower edge of the ice block M. Since the scales S formed in the areas along the upper edges of ice blocks M are not formed in the direction of the ice blocks M falling down, the scales S do not cause an obstacle to sliding of the ice blocks M. In addition, since the scales S formed in the areas along the lower edge of the ice blocks M are formed mainly on outer surfaces of the link portions 24 positioned below the inclined portions 22 and do not much project towards the inclined portions 22, the ice blocks M are not easily caught in this scale S and the scale S hardly causes an obstacle to sliding of the ice blocks M.

According to the ice making unit of the flow-down type ice making machine of the Embodiment described above, the following actions and effects are achieved.

(A) Since the respective vertically adjacent inclined portions 22 in each ice making region 20 are apart, relative to front and back, between the lower inclination end of the inclined portion 22 above and the upper inclination end of the inclined portion 22 below, each inclined portion 22 can be disposed vertically adjacent to each other. That is, since it is not required to consider the contact with a projection or the like as in conventional techniques, the vertical intervals between the horizontal extensions 16*a* in each evaporation tube 16 can be made narrower and the vertical dimensions of the ice making portions 10 can be made smaller. Accordingly, the size of each ice making plate 14 can be smaller, so that the vertical dimensions of the ice making unit 12 and the ice making machine itself can be downsized, and thus the production costs can be reduced.

(B) The ice making surface portion 19 in each ice making region 20 has the inclined portions 22 and the coupling portions 24 disposed vertically alternately to be in a concave and convex shape, and the inclined portions 22 and the link portions 24 are provided consecutively in a zigzag manner relative to the projected rims 18, so that deformation of the projected rims 18 to fall on the ice making regions 20 is suppressed. Accordingly, the ice block M formed on each inclined portion 22 is prevented from being caught in the projected rims 18, and excessive melting of the ice block M can be prevented caused by deformation of the projected rims 18.

(C) The gaps between the respective ice making portions with each other and the gaps between them and the side walls 36 are made smaller, thereby lowering the temperature of the entire space surrounded by the both side walls 36, 36 in ice making operation for a short period of time and also reducing the time period to generate the ice block M, and thus the ice making capacity is improved.

(D) Each channel 28 formed between the upper inclination ends on the back faces of the inclined portions 22, 22 formed in the uppermost portions of the ice making plates 14, 14 has the width narrower than the diameter of the evaporation tubes 16, so that, as illustrated in FIG. 1, the deicing water supplied to the space between the feed portions 26, 26 from the deicing water sprays 34 passes through the channel 28 having the narrow width, thereby facilitating the flow divided into the back faces of the inclined portions 22, 22 facing each other. That is, the deicing water also flows on the back faces of the inclined portions 22, 22 positioned above the horizontal extension 16*a* in the uppermost portion of each evaporation tube 16, and the efficiency of deicing the ice blocks M, M generated in the uppermost portions is improved. Accordingly, the ice blocks M in the uppermost portions is prevented from being melted more than necessary and the ice making capacity is improved.

(E) Since the ice making surface portion 19 in each ice making region 20 has the inclined portions 22 and the coupling portions 24 disposed vertically alternately to be in a concave and convex shape, the flow down rate is suppressed when the ice making water supplied from above the ice making plates 14 falls down along the ice making surface portion 19, and the decrease in the ice making efficiency due to the scattering of the ice making water is prevented. Even when the amount of the ice making water supply is reduced, the ice making water falls down while spreading out the entire surface of each inclined portion 22, and thus the ice making water can be frozen efficiently on each inclined portion 22. Moreover, since the amount of the ice making water supply is suppressed, the required ice making water supply is enabled for a compact pump motor with a small output, and thus it is possible to contribute to reduction in costs for the ice making unit and energy saving.

(F) During the formation of an ice block M on each inclined portion 22, the flow down rate of the ice making water is suppressed even when the ice making water falls down along the outer surface of the ice block M, so that a decrease in the ice making efficiency due to the spattering of the ice making water is prevented.

(G) Since the respective vertically adjacent inclined portions 22 in each ice making region 20 are apart, relative to front and back, between the lower end edge of the inclined portion 22 above and the upper end edge of the inclined portion 22 below, the ice blocks M formed on the respective inclined portion 22 are prevented from coupling lengthwise with each other even when both the inclined portions 22 are vertically adjacent to each other.

(H) Since the ice blocks M formed on the inclined portions 22, 22 adjacent widthwise sandwiching the projected rims 18 in each ice making region 20 are transversely coupled sandwiching the projected rims 18, the length of the scales S formed in the areas along the edges of the ice blocks M on the projected rims 18 is shortened, and thus the scales S can be prevented from causing an obstacle to sliding of the ice blocks M in deicing operation. Accordingly, it is possible to prevent occurrence of making ice doubly, freeze-up, and the like caused by the scales S.

(I) Even when the surface tension of the melted water acts on an ice block M, the ice block M is promptly separated from the ice making surface of the inclined portion 22, so that it does not happen that the ice block M is melted more than necessary to decrease the ice production per cycle, and thus the ice making capacity is improved. In addition, since an ice block M dissolved from the freezing with an inclined portion 22 does not stay on the ice making surface of the inclined portion 22, formation of an ice block M having poor appearance due to excessive melting and occurrence of making ice doubly are also prevented.

(J) In the ice making portions 10 of this Embodiment, ice blocks M sliding down on the inclined portions 22 in deicing operation fall down from the inclined portions 22 smoothly without hitting a projection or the like, so that the ice blocks M do not rotate and the like. Accordingly, the intervals separating the respective ice making portions from each other and the intervals separating the ice making portions 10 from the side walls 36 can be made narrower in the ice making unit 12, and the dimensions in the alignment of the ice making portions 10 in the ice making unit 12 can be made smaller for downsizing. In addition, because of the downsizing of the ice making unit 12, the ice making machine itself can also be downsized.

Modifications

The present invention is not limited to the configuration of the Embodiment described above and can employ other configurations appropriately.

(1) In the ice making portion of the Embodiment, the projecting dimension of the projected rims projecting out on the surfaces of the ice making plates may also be set to a value less than the thickness of ice blocks to be generated on the inclined portions, that is, a value that allows horizontally (widthwise) adjacent ice blocks generated on inclined portions to be partially coupled to each other upon completion of ice making. Specifically, it is sufficient that the projecting ends of the projected rims are set to be positioned closer to the back side (side to be close to the evaporation tube) than the maximum projecting position, towards the front side, of the ice blocks generated on the inclined portions upon completion of making ice. By configuring in such a manner, the plurality of ice blocks coupled to each other beyond the projected rims in deicing operation slide down at once, thereby enabling to separate the ice blocks from the inclined portions more smoothly. Since the ice blocks coupled to each other are separated by the impact of falling down in the ice storage, they can be used as individual ice block units at the time of use.

(2) Although the description in the Embodiment is given to a case of disposing the ice making unit consisting of the plurality of ice making portions in the ice making machine, such an ice making unit may also be configured with one ice making portion.

(3) Although the ice making portion is described in the Embodiment in a configuration of disposing the pair of ice making plates facing each other sandwiching the evaporation tube, it is not limited to this configuration but can employ a configuration of being provided with an evaporation tube on a back face of one sheet of ice making plate.

(4) The number of steps of inclined portions formed in each ice making plate and the number of ice making portions configuring each ice making unit are not limited to those illustrated in the Embodiment but can be set arbitrarily.

The invention claimed is:

1. An ice making unit for a flow-down ice making machine, comprising an ice making portion having: an ice making plate provided at predetermined horizontal intervals with a plurality of projected rims projecting out on a front side and also extending vertically; and an evaporation tube disposed on a back face of the ice making plate opposite to the front side and meandering to have horizontally extending horizontal extensions vertically apart from each other, to generate an ice block by supplying ice making water to an ice making surface portion positioned between the projected rims in the ice making plate, wherein the ice making surface portion is provided with vertical steps of inclined portions inclined from a back side to a front side as directed downwardly from above, a lower inclination end of each inclined portion is configured to be positioned closer to the front side than an upper inclination end of an inclined portion positioned below, and the horizontal extensions of the evaporation tube are disposed to make contact with a back face of each inclined portion, the ice making portion is configured to dispose a pair of ice making plates having back faces facing each other and sandwiching the evaporation tube, and a channel for deicing water having a width narrower than a diameter of the evaporation tube is formed between upper inclination ends of back sides of inclined portions facing each other and sandwiching the horizontal extensions of the evaporation tube.

2. The ice making unit for a flow-down ice making machine according to claim 1, wherein projecting ends of the projected rims are set to be positioned closer to a back side of the ice block generated on the inclined portion than a maximum projecting position of a front side of the ice block generated on the inclined portion, and generated ice blocks that are adjacent horizontally are configured to be coupled to each other beyond the projected rims.

3. The ice making unit for a flow-down ice making machine according to claim 1, wherein a plurality of ice making portions are disposed in parallel and spaced apart at predetermined intervals.

4. The ice making unit for a flow-down ice making machine according to claim 2, wherein a plurality of ice making portions are disposed in parallel and spaced apart at predetermined intervals.

* * * * *